US006443728B1

(12) United States Patent
Edberg et al.

(10) Patent No.: US 6,443,728 B1
(45) Date of Patent: Sep. 3, 2002

(54) GAS PIPE IGNITOR

(75) Inventors: Carl D. Edberg, Stafford Springs, CT (US); Raymond D. MacWhinnie, Springfield, MA (US); David J. Matteson, Avon; Raymond W. Cournoyer, Enfield, both of CT (US)

(73) Assignee: Alstom (Schweiz) AG, Baden (CH)

( * ) Notice: Subject to any disclaimer, the term of this patent is extended or adjusted under 35 U.S.C. 154(b) by 0 days.

(21) Appl. No.: 09/812,056

(22) Filed: Mar. 19, 2001

(51) Int. Cl.[7] ..... F23D 14/48; F23D 14/78; F23D 14/84

(52) U.S. Cl. ..... 431/266; 431/264; 431/284; 431/286; 431/349; 431/350

(58) Field of Search ..... 431/353, 266, 431/265, 264, 286, 284, 278, 349, 350; 60/39.826, 39.827

(56) References Cited

U.S. PATENT DOCUMENTS

| | | | | |
|---|---|---|---|---|
| 2,156,405 | A | * | 5/1939 | Smoot |
| 2,405,196 | A | * | 8/1946 | Elliot et al. |
| 2,473,769 | A | * | 6/1949 | Schinman |
| 2,603,280 | A | * | 7/1952 | Bernhard |
| 2,784,778 | A | * | 3/1957 | Milton |
| 2,992,459 | A | * | 7/1961 | Campbell |
| 3,418,060 | A | * | 12/1968 | Spielman et al. |
| 3,570,471 | A | * | 3/1971 | Lazaridis |
| 3,729,287 | A | * | 4/1973 | Strashok |
| 5,865,616 | A | * | 2/1999 | George |
| 6,079,976 | A | * | 6/2000 | Nishiyama et al. |

FOREIGN PATENT DOCUMENTS

| | | | | |
|---|---|---|---|---|
| DE | 24 49 986 | * | 10/1975 | 431/9 |
| DE | 31 44574 | * | 5/1983 | 431/350 |
| DE | 291 616 | * | 7/1991 | 431/8 |
| EP | 884 528 | * | 2/1998 | 431/8 |
| GB | 1314813 | * | 4/1973 | 431/265 |
| GB | 1 565 247 | * | 4/1980 | 431/353 |
| JP | 60-66021 | * | 4/1985 | 431/8 |
| JP | 2-103304 | * | 4/1990 | 431/350 |
| JP | 2001-50502 | * | 2/2001 | 431/349 |

* cited by examiner

*Primary Examiner*—Carl D. Price
(74) *Attorney, Agent, or Firm*—Russell W. Warnock

(57) ABSTRACT

A gas pipe ignitor 10 is provided which is operable to ignite a non-premixed air and fuel mixture and includes an air supply conduit 20 which has an axis ASL, a supply end 22, and a flame end 24 axially spaced from the supply end 22. The gas pipe ignitor also includes a fuel supply conduit 26 extending axially interiorly within at least a portion of the air supply conduit 20 and having an entrance end 28 and an exit end 30. The gas pipe ignitor further includes two branch passages 32 each communicated with the fuel supply conduit 26. The gas pipe ignitor also includes a deflector body 38 disposed in the air supply conduit 20 and is configured relative to the air supply conduit 20 such that air flowing in the air supply conduit 20 flows along a pass through passage PTP from upstream of the upstream most surface 40 of the deflector body 38 to downstream of the deflector body 38. The entrance end 28 of the fuel supply conduit 26 is disposed axially upstream of the upstream most surface 40 of the deflector body 38. The exit end 30 of the fuel supply conduit 26 is disposed relative to the deflector body 38 and the air supply conduit 20 at a location FSE downstream of the upstream most surface 40 of the deflector body such that fuel flowing in the fuel supply conduit 26 from its entrance end 28 to its exit end 30 is isolated from contact with air in the air supply conduit 20 until exiting the exit end 30 of the fuel supply conduit 26. The exit end 36 of each branch passage 32 is radially spaced from the exit end 30 of the fuel supply conduit 26. The gas pipe ignitor also includes an ignition element 42, as seen in FIG. 2, for promoting the ignition of the fuel which has exited the branch passages 32.

6 Claims, 8 Drawing Sheets

GAS PIPE IGNITOR

BACKGROUND OF THE INVENTION

Gas pipe ignitors are used in industrial and utility scale boilers to bring the boiler temperature up before introducing the main fuel and also to light the main fuel once it is introduced. Additional uses include operation during periods of high demand to increase the heat rate of the boiler. One known configuration of the gas pipe ignitor uses a stabilized pilot flame to ignite and stabilize a larger, non-premixed diffusion primary flame at the flame end of the ignitor. Combustion air for the pilot flame is supplied through the ignitor, while combustion air for the primary flame is scavenged from the boiler environment. High capacity gas ignitors may conventionally use two separate fuel pipes for the delivery of gas. One pipe is used for the pilot gas and primary gas, while the other is used for boost gas. The pilot/primary gas pipe contains a number of small weep holes, positioned near a spark discharge for ignition. This pipe has an orifice mounted in the discharge end that is used to create the pressure differential necessary to force gas out of the weep holes while still allowing the primary gas jet to be discharged from the end. In cases where a greater firing rate is desired, the boost fuel pipe is activated. In that case, the boost fuel pipe discharges fuel at the same location as the end of the pilot/primary gas pipe. Both of the pipes are located inside of the air supply pipe which carries combustion air for the pilot flame. Additionally, a spark rod used for ignition and a separate flame detector rod are mounted inside of the air supply pipe.

Approximately 35% of the internal volume of the air supply pipe is occupied by the fuel pipes and these other fittings resulting in a high velocity turbulent air flow through the air supply pipe and significant drag losses owing to the high surface area of the internal pipes and fittings. Further, structures within the air supply pipe result in high frictional losses exacerbated by the high upstream air velocity.

The limit on the firing capacity of the ignitor depends on a number of key variables. The heat input from the bluff body stabilized pilot flame dictates the lift-off and blow-off characteristics of the main jets. The size of the pilot flame is dependent on how much combustion air can be supplied through the ignitor as well as on the size and geometry of the recirculation zone. Also, the outlet diameters of the main jets determine the exiting velocity of the gas for a given flow rate. With limitations on the air pressure available for the pilot combustion air, it becomes necessary to reduce the flow induced frictional losses caused by the presence and location of pipe and fittings as well as other combustion supporting structure in the air supply pipe.

U.S. Pat. No. 5,865,616 to George describes a premix gas burner having a main gas tube, a pilot tube, and an ignitor. This conventional burner is representative of the complexity and number of conduits for air and fuel supply that may be comprised in a burner.

SUMMARY OF THE INVENTION

An object of the present invention is to provide a gas pipe ignitor having a high firing capacity with reduced frictional flow losses.

A further object of the present invention is to provide a gas pipe ignitor which produces a pilot flame well mixed with air in a controlled zone in which combustion is initiated and sustained. Yet another object of the present invention is to provide a gas pipe ignitor which offers an improvement in the quantity of combustion air available at the same pressure loss as compared with prior art ignitors.

According to one aspect of the present invention, the gas pipe ignitor has a single fuel pipe running through the air supply pipe with the single fuel pipe providing fuel for the pilot flame and for the primary ignitor combustion fuel. A truncated spherical bluff body located in the air supply pipe reduces the flow entrance losses and maintains the necessary downstream turbulence and recirculation zone. The bluff body has a central opening for the fuel pipe and is orificed to provide the desired ratio of pilot gas to primary gas. Integral pilot fuel ports are circumferentially located around the orifice to provide the pilot gas to the truncated face of the bluff body where the pilot gas is evenly distributed by a diffuser ring.

DETAILED DESCRIPTION OF THE PREFERRED EMBODIMENT

Figure 1:
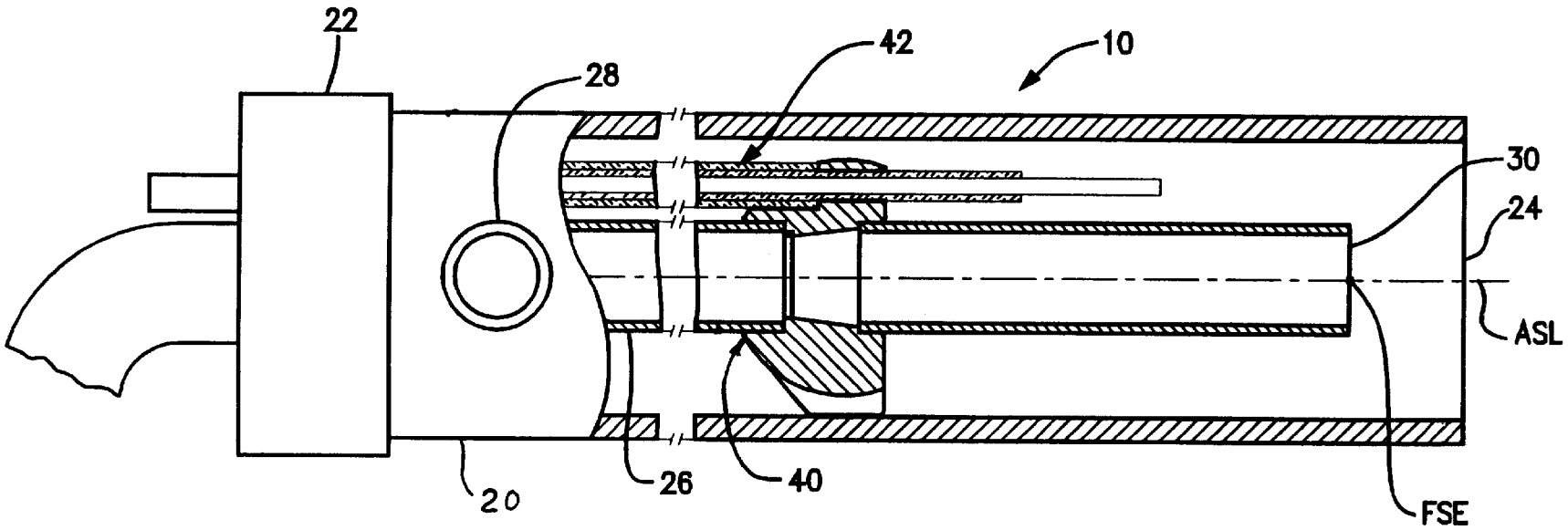
FIG. 1 is a side view of one embodiment of the gas pipe ignitor of the present invention partially broken-away in cross section.
Figure 2:
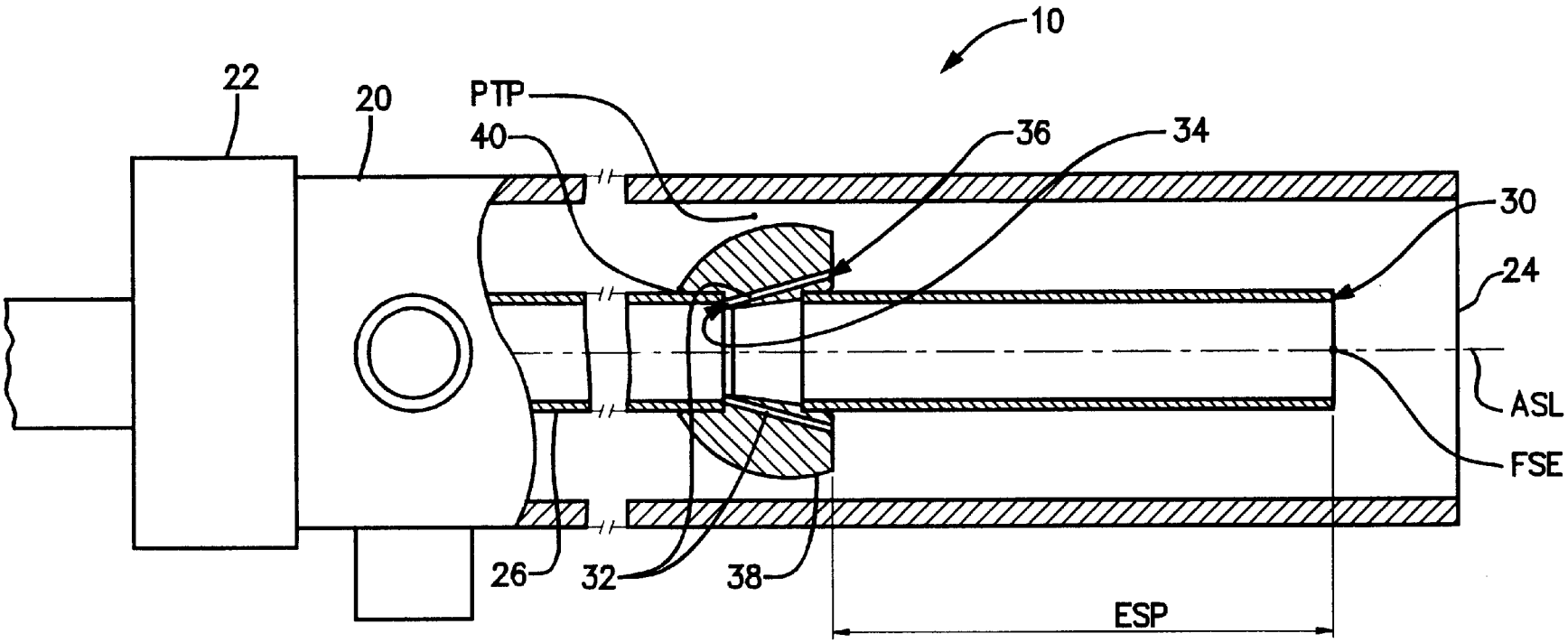
FIG. 2 is a bottom view of the ignitor of FIG. 1.
Figure 3:
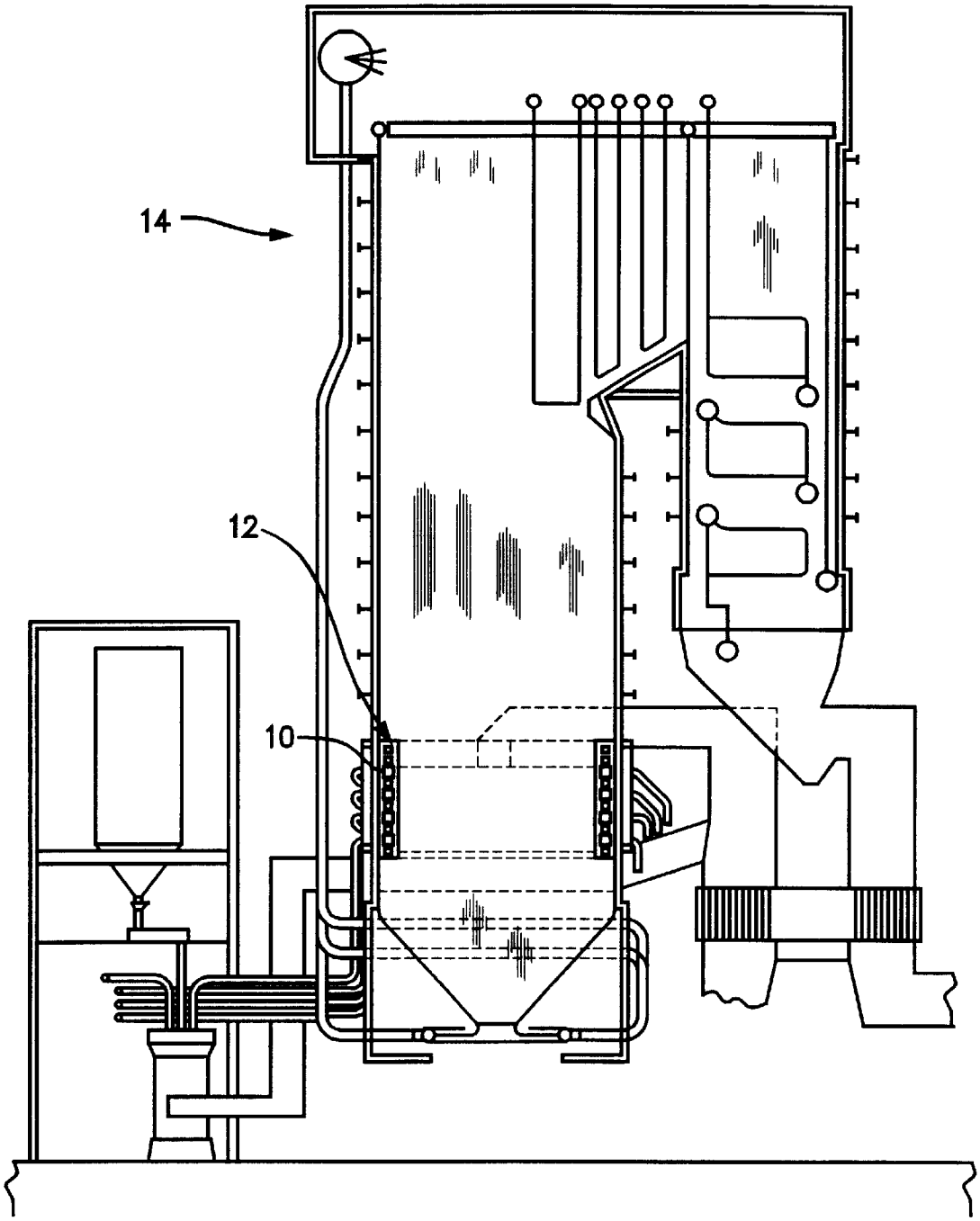
FIG. 3 is a schematic view of a pulverized coal firing combustion assembly having the gas pipe ignitor shown in FIGS. 1 and 2 mounted thereon.
Figure 4:
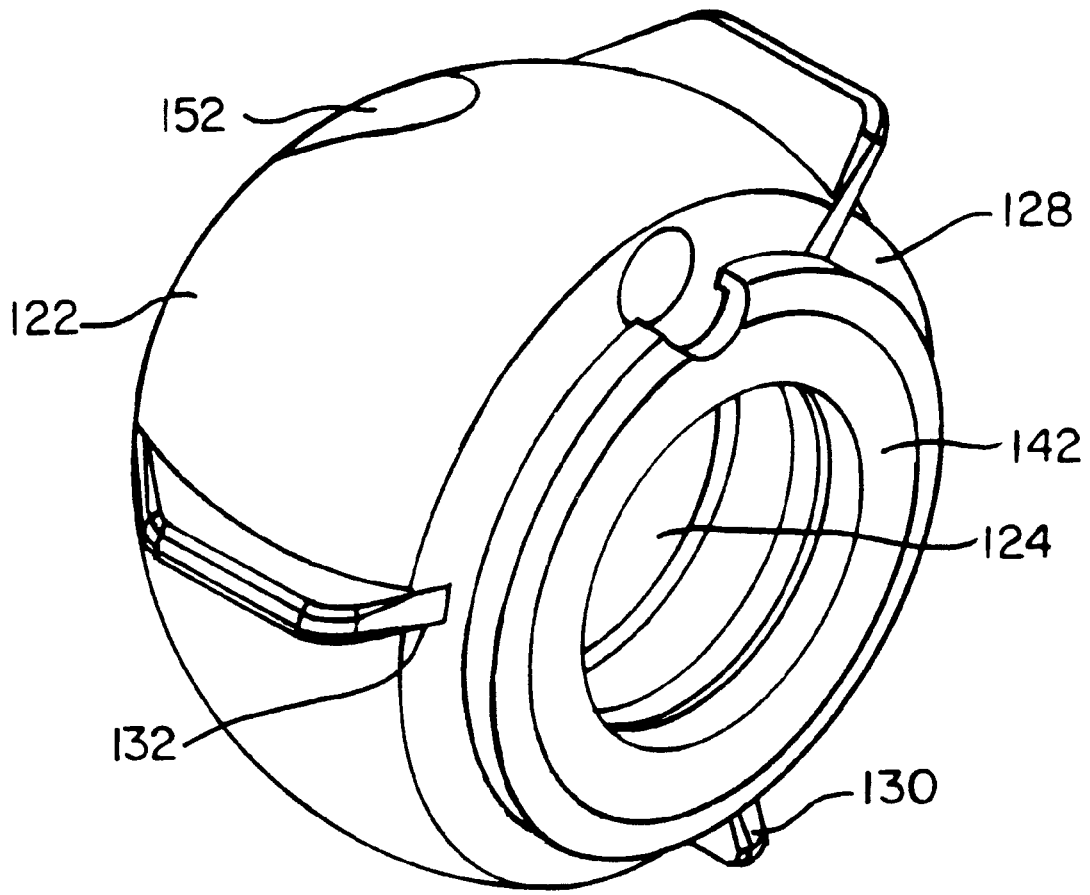
FIG. 4 is an enlarged perspective view of the bluff body of another embodiment of the gas pipe ignitor of the present invention and showing the bluff body with the spacers and diffuser ring attached.
Figure 5:
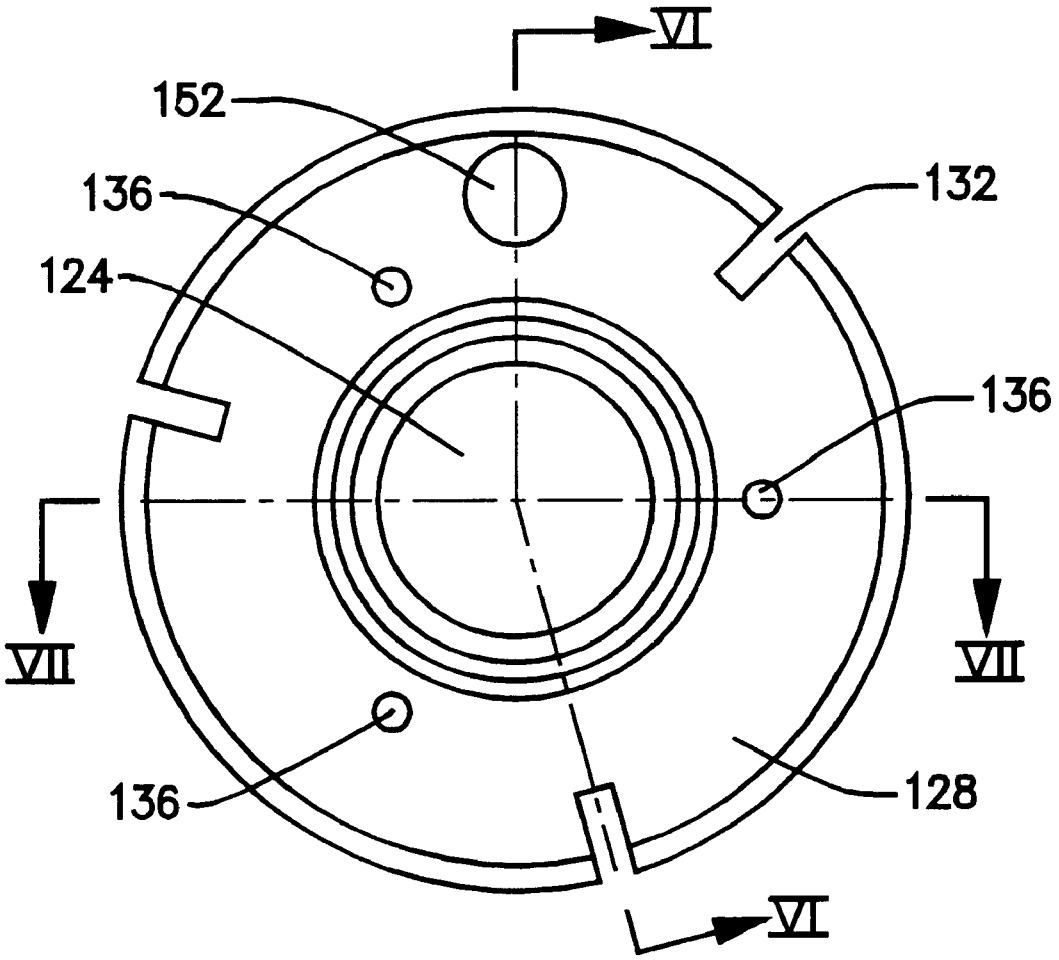
FIG. 5 is a view of the truncated face of the bluff body shown in FIG. 4.

As seen in FIGS. 1, 2, and 3, one embodiment of the gas pipe ignitor of the present invention, generally designated as the gas pipe ignitor 10, is adapted to be mounted on a structural element of a fossil fuel firing combustion assembly such as, for example, on a structural element 12 of a pulverized coal firing furnace 14, which may be, for example, a structural element in the form of a corner windbox, as seen in particular in FIG. 3. The gas pipe ignitor 10 is also operable to ignite a fuel such as oil or another liquid fuel or provide auxiliary or special combustion or heating service to the fossil fuel firing combustion assembly. The gas pipe ignitor 10 can be operated, for example, to warm up the combustion chamber of the pulverized coal firing furnace 14 during a start up operation thereof at a stage of the start up operation prior to the combustion of pulverized coal introduced into the combustion chamber by the pulverized coal compartments 16 mounted in the windboxes 18 of the pulverized coal firing furnace 14. Alternatively or in addition, the gas pipe ignitor 10 can be operated to light the main fuel such as, for example, the pulverized coal in a pulverized coal firing combustion assembly.

As seen in particular in FIGS. 1 and 2, the gas pipe ignitor 10 is operable to ignite a non-premixed air and gaseous fuel mixture and includes an air supply conduit 20 which has an axis ASL, a supply end 22, and a flame end 24 axially spaced from the supply end 22. The gas pipe ignitor also includes a fuel supply conduit 26 extending axially interiorly within at least a portion of the air supply conduit 20 and having an entrance end 28 and an exit end 30. The gas pipe ignitor further includes, as best seen in FIG. 2, at least one branch passage; for illustration purposes, the gas pipe ignitor is shown with two branch passages 32. Each branch passage 32 has an entrance end 34 and an exit end 36 spaced from the entrance end 34. The entrance end 34 of each branch passage 32 is communicated with the fuel supply conduit 26. The gas pipe ignitor also includes a deflector body 38 disposed in the air supply conduit 20 and is configured relative to the air supply conduit 20 such that air flowing in the air supply conduit 20 flows along a pass through passage PTP from upstream of the upstream most surface 40 of the deflector body 38 to downstream of the deflector body 38. The entrance end 28 of the fuel supply conduit 26 is disposed axially upstream of the upstream most surface 40 of the deflector body 38. The exit end 30 of the fuel supply conduit 26 is disposed relative to the deflector body 38 and the air supply conduit 20 at a location FSE downstream of the upstream most surface 40 of the deflector body such that fuel flowing in the fuel supply conduit 26 from its entrance end 28 to its exit end 30 is isolated from contact with air in the air supply conduit 20 until exiting the exit end 30 of the fuel supply conduit 26. The exit end 36 of each branch passage 32 is disposed relative to the deflector body 38 such that fuel exiting the respective branch passage 32 through its exit end 36 is in contact with air in the air supply conduit 20 which has passed downstream of the upstream most surface 40 of the deflector body 38 along the pass through passage PTP. The exit end 36 of each branch passage 32 is radially spaced from the exit end 30 of the fuel supply conduit 26. The gas pipe ignitor also includes an ignition element 42, as seen in FIG. 2, for promoting the ignition of the fuel which has exited the branch passages 32. This ignition element 42 can also be used to flame presents.

The exit end 30 of the fuel supply conduit 26, as seen in FIG. 2, is axially spaced downstream of the exit ends 36 of the branch passages 32 by a distance ESP.

Figure 8:
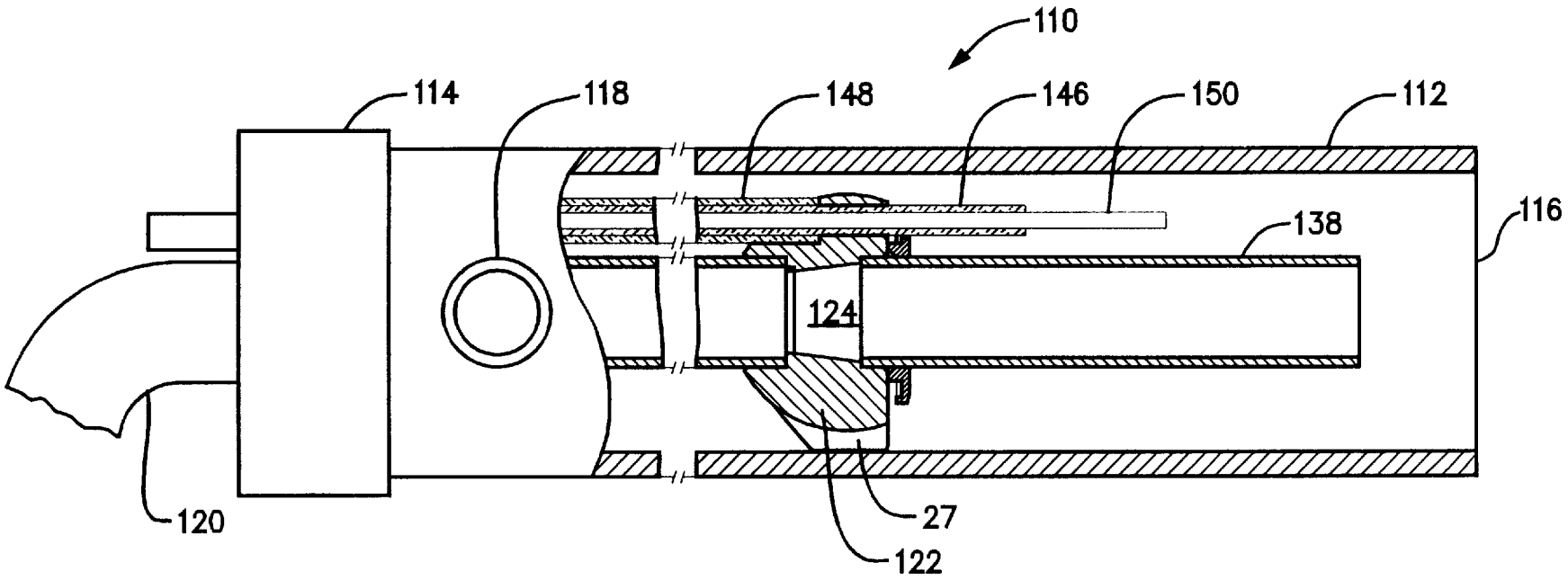
FIG. 8 is a side view of one embodiment of the another embodiment of the gas pipe ignitor of the present invention partially broken-away in cross section.
Figure 9:
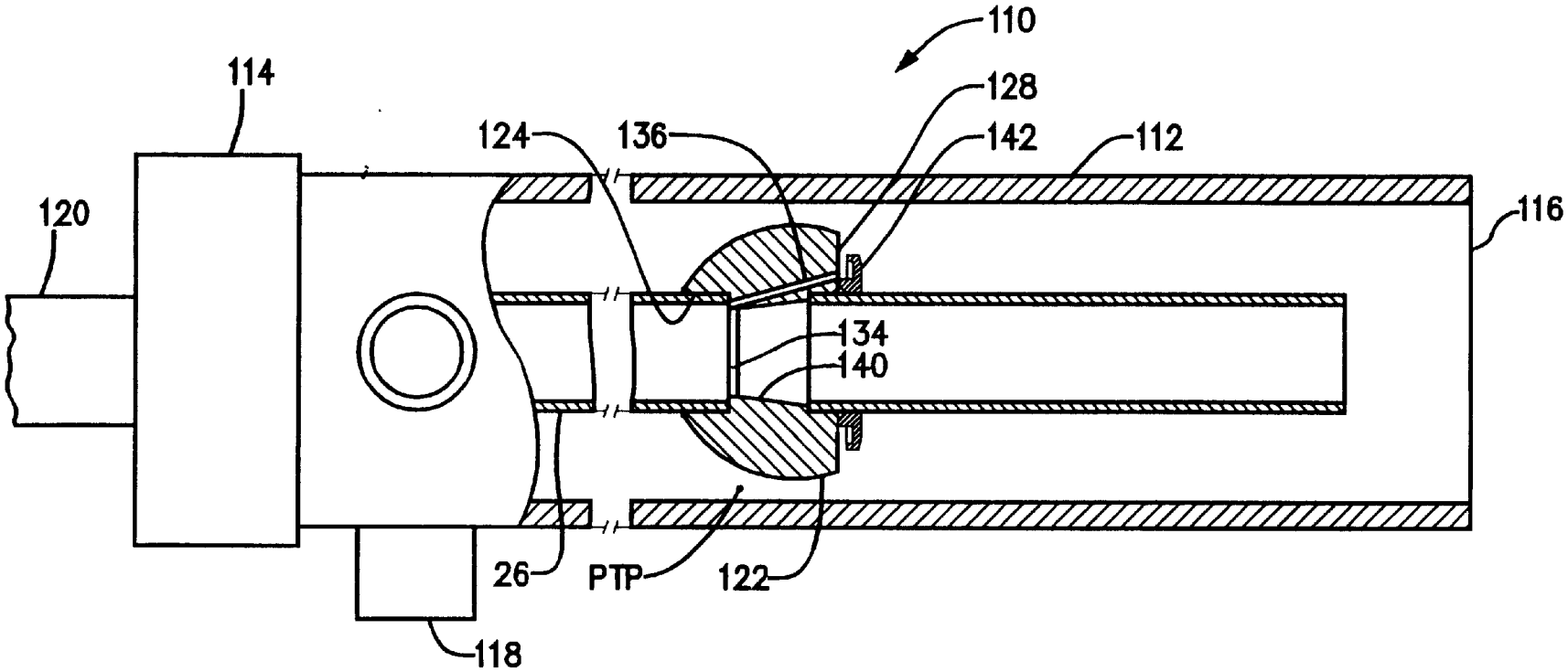
FIG. 9 is a bottom view of the ignitor shown in FIG. 8.

FIGS. 4, 5, 6, 7, 8, and 9 illustrate another embodiment of the gas pipe ignitor of the present invention which includes the features of a truncated spherical bluff body and centrally located integral fuel supply pipe inside of an air supply pipe or conduit to provide a pilot fuel well mixed with air in a controlled zone in which combustion is initiated and sustained. The same centrally located fuel supply pipe also serves as the conduit for the primary ignitor fuel. Referring to FIGS. 8 and 9 which illustrate a side view and a bottom view of the ignitor 110 respectively, there is an air supply pipe or conduit 112 having an axis ASL and having a supply end 114 and a flame end 116. Adjacent the closed supply end 114 is an air supply attachment or nipple 112 through which air is introduced into the air supply conduit 112. A fuel supply conduit in the form of a single fuel supply pipe 120 enters the air supply conduit 112 at this closed supply end 114 and is attached to a deflector body in the form of a truncated spherical bluff body 122 at a central opening 124 of the bluff body 122. The fuel supply pipe 120 is attached into the recessed portion 126 of the central opening 124. The central opening 124 extends completely through the bluff body 122.

The bluff body 122 is spherical or essentially spherical with a truncated downstream face 128. The spherical shape minimizes air flow friction losses while providing a compact shape. The location for the plane of the truncated face 128 is in the range beginning at the center of the sphere to a point from the center that is not greater than 35% of the spherical diameter. This range is based on providing the greatest downstream turbulence and recirculation zone length with the least frictional losses. The preferred location of the truncated plane is about 20% of the diameter of the sphere away from the center in the downstream direction.

The bluff body 122 is supported in the air supply conduit 112 by means of the support vanes 130 mounted in the slots 132 in the bluff body such that the diametral axis of the bluff body on which its central opening 124 is centered is coaxial with the axis ASL of the air supply conduit 112. The diameter of the bluff body 120 is selected to be in proportion to the inside diameter of the air supply conduit 112 to provide the appropriate downstream turbulence. As an example, for a three-inch schedule 40 air supply conduit which has an inside diameter of 3.068 inches, the preferred bluff body diameter is in the range of 75 to 90% (seventy-five to ninety percent) of that inside diameter.

The central opening 124 of the bluff body 120 is communicated in the bluff body with an orifice 134 integrally formed in the bluff body 122 which is sized to provide a desired ratio of pilot fuel to primary fuel. Integral pilot fuel ports 136 are circumferentially spaced at the orifice shoulder. The number of pilot fuel ports 136 is selected to be appropriate for the total fuel flow with three being illustrated in the drawings. These pilot fuel ports pass through the bluff body to the truncated face 128 at a diverging angle to the axis of the fuel pipe and to the central opening such that the pilot fuel ports exit at the truncated face outside of the fuel supply pipe extension 138. The size of the orifice 134 establishes a differential pressure ratio between the upstream and downstream sides of the bluff body such that correctly proportioned fuel flow between the pilot ports and the main fuel discharge will occur. The inside throat of the bluff body is tapered at 140 from the minimum diameter orifice 134 to the inside diameter of the fuel supply pipe extension 138 to allow the fuel flow to expand back to the full area of the inside of the air supply conduit 112. This achieves a lower outlet velocity for the primary fuel jet.

Attached into the taper 140 of the minimum diameter orifice 134 at the downstream, truncated face of the bluff body 122 is the fuel supply pipe extension 138, the downstream end of which defines the location FSE which is downstream of the upstream most surface of the bluff body 122 such that fuel flowing successively through the fuel supply pipe 120, the central opening 124 and the minimum diameter orifice 134 in the bluff body 122, and the fuel supply pipe extension 138 is isolated from contact with the air in the air supply conduit 112 until exiting the downstream end of the fuel supply pipe extension 138. As shown in FIGS. 8 and 9, this fuel supply pipe extension 138 extends toward the flame end 116 of the ignitor and is of a length sufficient to isolate the pilot fuel and air mixture from the primary fuel thereby allowing combustion initiation of the pilot flame within flammability limits. The fuel supply pipe extension may or may not terminate within the length of the air supply conduit 112. In general, it extends beyond the recirculation zone created by the air flow over the bluff body.

Figure 6:
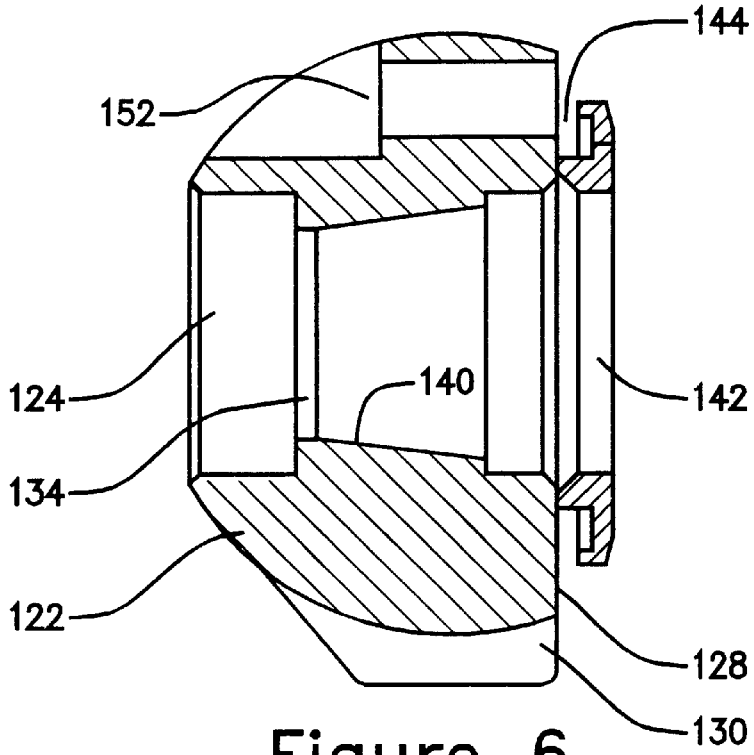
FIG. 6 is a cross-section view of the bluff body taken along line VI—VI of FIG. 5 and further includes the diffuser ring.
Figure 7:
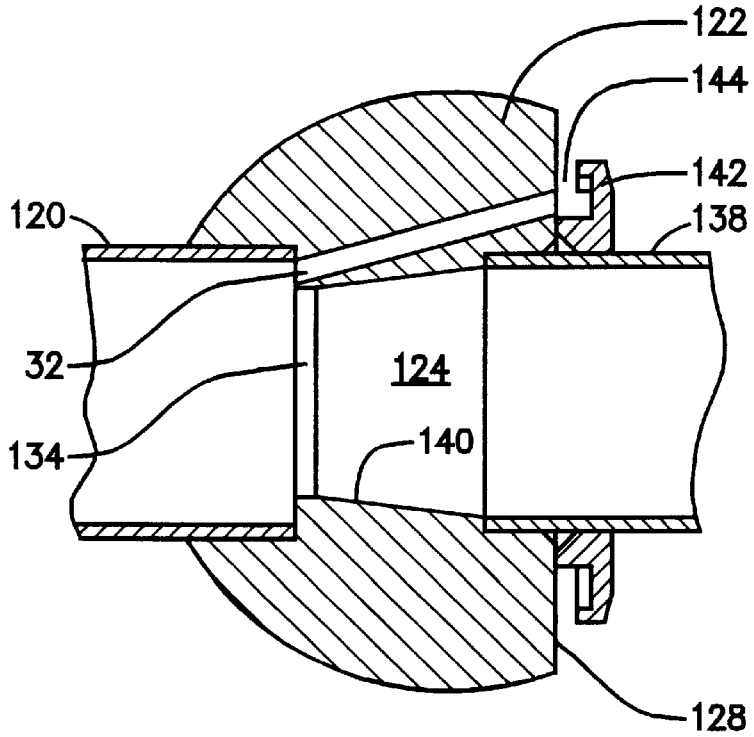
FIG. 7 is a cross-section of the bluff body taken along line VII—VII of FIG. 5 and also includes the diffuser ring as well as sections of the fuel supply pipe as it enters and exits the bluff body.

Located at the truncated face 128 of the bluff body 122 and around the fuel supply pipe extension 138 is a diffusion ring 142. As best shown in FIG. 6, the pilot fuel is discharged from the exit of the pilot fuel ports 136 into the annular space 144 created between the bluff body 122 and the diffusion ring 142. This serves to distribute the pilot fuel evenly into the combustion air flowing in the air supply conduit around the outside of the bluff body.

Also mounted within the air supply conduit 112 is the electrical spark discharge pilot ignition device as shown in FIG. 8. This comprises ceramic insulator tubes 146 and 148 and the central conductive spark rod 150. This device is mounted in and through the aperture 152 in the bluff body 122. Upon passing through the bluff body, the ceramic insulators covering the spark rod terminate allowing the spark rod to discharge on the downstream side of the bluff body.

While several variations of an embodiment of the invention have been shown, it will be appreciated that modifications thereof, some of which have been alluded to hereinabove, may still be readily made thereto by those skilled in the art. It is therefore intended by the appended claims to cover the modifications alluded to herein as well as all the other modifications which fall within the true spirit and scope of the invention.

What is claimed is:

1. A gas pipe ignitor for igniting a non-premixed air and fuel mixture, comprising:

an air supply conduit having an axis along its length, a supply end, and a flame end axially spaced from the supply end;

a fuel supply conduit extending axially interiorly within at least a portion of the air supply conduit, the fuel supply conduit having an entrance end and an exit end disposed downstream of the supply end of the air supply conduit, as viewed relative to the direction of flow of air in the air supply conduit;

a deflector body disposed in the air supply conduit at a location therein intermediate the entrance end and the exit end of the fuel supply conduit and the deflector body having an overall radial extent perpendicular to the axis of the air supply conduit which is greater than the overall radial extent of the fuel supply conduit such that the fuel supply conduit passes axially through the deflector body, the deflector body having an upstream face and a downstream face, as viewed relative to the direction of flow of air through the air supply conduit, and the deflector body being configured relative to the air supply conduit such that air flowing in the air supply conduit flows along a pass through passage extending between the upstream and downstream faces of the deflector body and the deflector body having a geometry to reduce the radial cross section of the air in the air supply passage to its minimum value at the pass through passage;

at least one branch passage formed as a bore in the deflector body and extending at an angle from the axis of the air supply conduit, the at least one branch passage having an inlet end communicated with the portion of the fuel supply conduit within the deflector body and an outlet end radially spaced from and upstream of the exit end of the fuel supply conduit such that some fuel in the fuel supply conduit diverts from the balance of the fuel and flows instead through the one branch passage with such diverted fuel not being in contact with air supplied through the air supply conduit until the fuel exits the branch passage through its outlet end into contact with air in the air supply conduit which has passed through the pass through passage; and an ignition element for promoting the ignition of the fuel which has exited the at least one branch passage, the ignition element extending from an end upstream of the deflector body to another end which is downstream of the at least one branch passage outlet end and upstream of the exit end of the fuel supply conduit.

2. A gas pipe ignitor according to claim 1 and further comprising a diffusion ring disposed relative to the outlet end of the at least one branch passage for angularly diffusing fuel exiting the branch passage.

3. A gas pipe ignitor according to claim 1 wherein the deflector body has a truncated spherical shape.

4. A gas pipe ignitor according to claim 1 wherein the deflector body includes a throughbore and the fuel supply conduit extends through the throughbore.

5. A gas pipe ignitor according to claim 4 wherein the at least one branch passage is formed by a bore in the deflector body and extends at an angle from the axis of the opening.

6. A gas pipe ignitor according to claim 1 and further comprising a diffusion ring disposed relative to the outlet end of the branch passage for angularly diffusing fuel exiting the branch passage.

* * * * *